US006478446B1

(12) United States Patent
Shen

(10) Patent No.: US 6,478,446 B1
(45) Date of Patent: Nov. 12, 2002

(54) SOCKET ASSEMBLY OF PROJECTION LAMP

(76) Inventor: Wei Hong Shen, 6F, No. 649-9, Chung Cheng Rd., Hsinchuang City, Taipei Hsien (TW)

( * ) Notice: Subject to any disclaimer, the term of this patent is extended or adjusted under 35 U.S.C. 154(b) by 0 days.

(21) Appl. No.: 09/848,416

(22) Filed: May 4, 2001

(51) Int. Cl.[7] ..... H01R 33/00
(52) U.S. Cl. ..... 362/226; 439/699.2
(58) Field of Search ..... 362/226, 538, 362/306; 439/617, 691, 686, 699.2

(56) References Cited

U.S. PATENT DOCUMENTS 4,928,210 A * 5/1990 Hayakawa et al. .... 313/318.02
5,813,885 A * 9/1998 Shen ..... 313/318.11
6,075,318 A * 6/2000 Noll et al. ..... 313/318.07
6,213,816 B1 * 4/2001 Meichsner et al. ..... 439/280

* cited by examiner

*Primary Examiner*—Sandra O'Shea
*Assistant Examiner*—John Amarantides
(74) *Attorney, Agent, or Firm*—Rabin & Berdo, P.C.

(57) ABSTRACT

A shade assembly of projection lamp includes an insulating body, two fixing members, two conductive plates and two resilient members. The insulating body has two receiving spaces therein and two insertion holes. The two fixing members each has a receiving recess for the conductive plate, one end of the fixing member is inserted and tightened into the receiving space. The two conductive plates each has a first lateral side and a second lateral side. The two conductive plates being arranged within the receiving recesses for a conductive plate; the conductive plate has a bottom end facing the insertion hole. Each of the two resilient members is provided between the insulating body and the conductive plate to enhance the clamping force for the conductive plate. The receiving space has an inner wall provided with an indent groove to prevent dragging out of the fixing member.

5 Claims, 7 Drawing Sheets

SOCKET ASSEMBLY OF PROJECTION LAMP

FIELD OF THE INVENTION

The present invention relates to a socket assembly of projection lamp, especially to a socket assembly of a projection lamp that is easy to manufacture and has a low cost.

BACKGROUND OF THE INVENTION

Lamps are becoming increasingly important for decoration. A diverse number of lamps, such as projection lamp, ceiling lamp, hanging lamp, table lamp and desktop lamp, have been developed to satisfy user's various needs.

The prior art projection lamp has a socket assembly 1*a* as shown in FIG. 1. The socket assembly has an insulating body 10*a* with sockets 11*a* on both sides thereof and connected to two leads of a lamp 14*a*. The leads of the lamp 14*a* are fixed by two screws 13*a*. The insulating body 10*a* has two nuts 12*a* on both sides thereof to tighten the sockets 11*a*. The two nuts 12*a* are connected to a supportive means and power unit to input power to the sockets 11*a* and provide power to the lamp 14*a*.

However, in above-mentioned socket assembly of the projection lamp, the structure is complicated and the projection lamp uses lots of screws and nuts, which is inconvenient.

SUMMARY OF THE INVENTION

It is the object of the present invention to provide a socket assembly of projection lamp, wherein the one end of the fixing member thereof is inserted and tightened into the receiving space to complete the assembling job. The assembling of the socket assembly of projection lamp is easy and the cost thereof is low.

To achieve above object, the present invention provides a socket assembly of projection lamp comprises an insulating body, two fixing members, two conductive plates and two resilient members. The insulating body has two receiving spaces therein and two insertion holes. The two fixing members each has a receiving recess for the conductive plate, one end of the fixing member is inserted and tightened into the receiving space. The two conductive plates each has a first lateral side and a second lateral side. The two conductive plates being arranged within the receiving recesses for a conductive plate; the conductive plate has a bottom end facing the insertion hole. Each of the two resilient members is provided between the insulating body and the conductive plate to enhance the clamping force for the conductive plate. The receiving space has an inner wall provided with an indent groove to prevent dragging out of the fixing member.

The various objects and advantages of the present invention will be more readily understood from the following detailed description when read in conjunction with the appended drawing, in which.

DETAILED DESCRIPTION OF THE INVENTION

Figure 1:
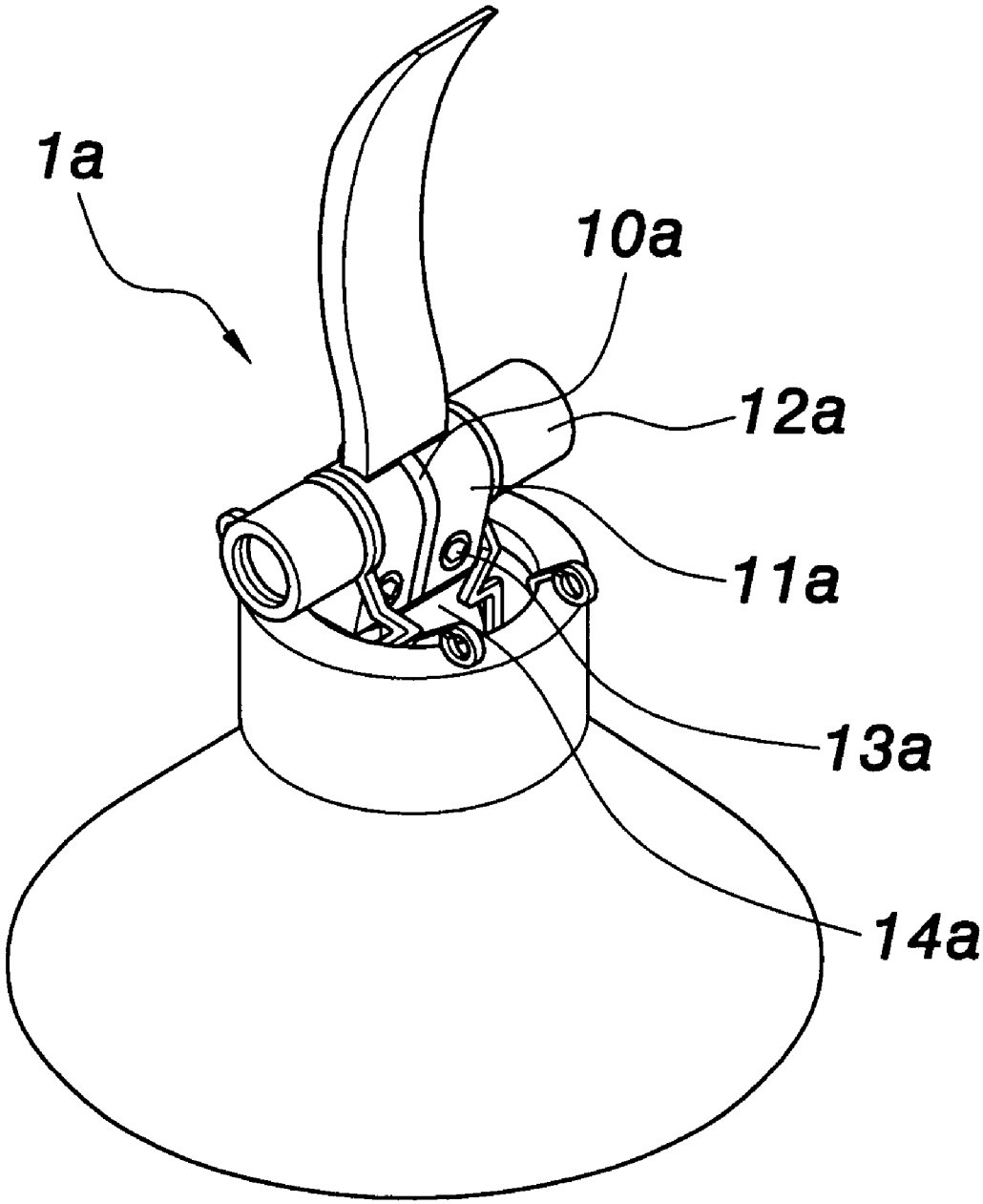
FIG. 1 PRIOR ART
FIG. 1 shows an exploded view of a prior art socket assembly of a projection lamp.
Figure 2:
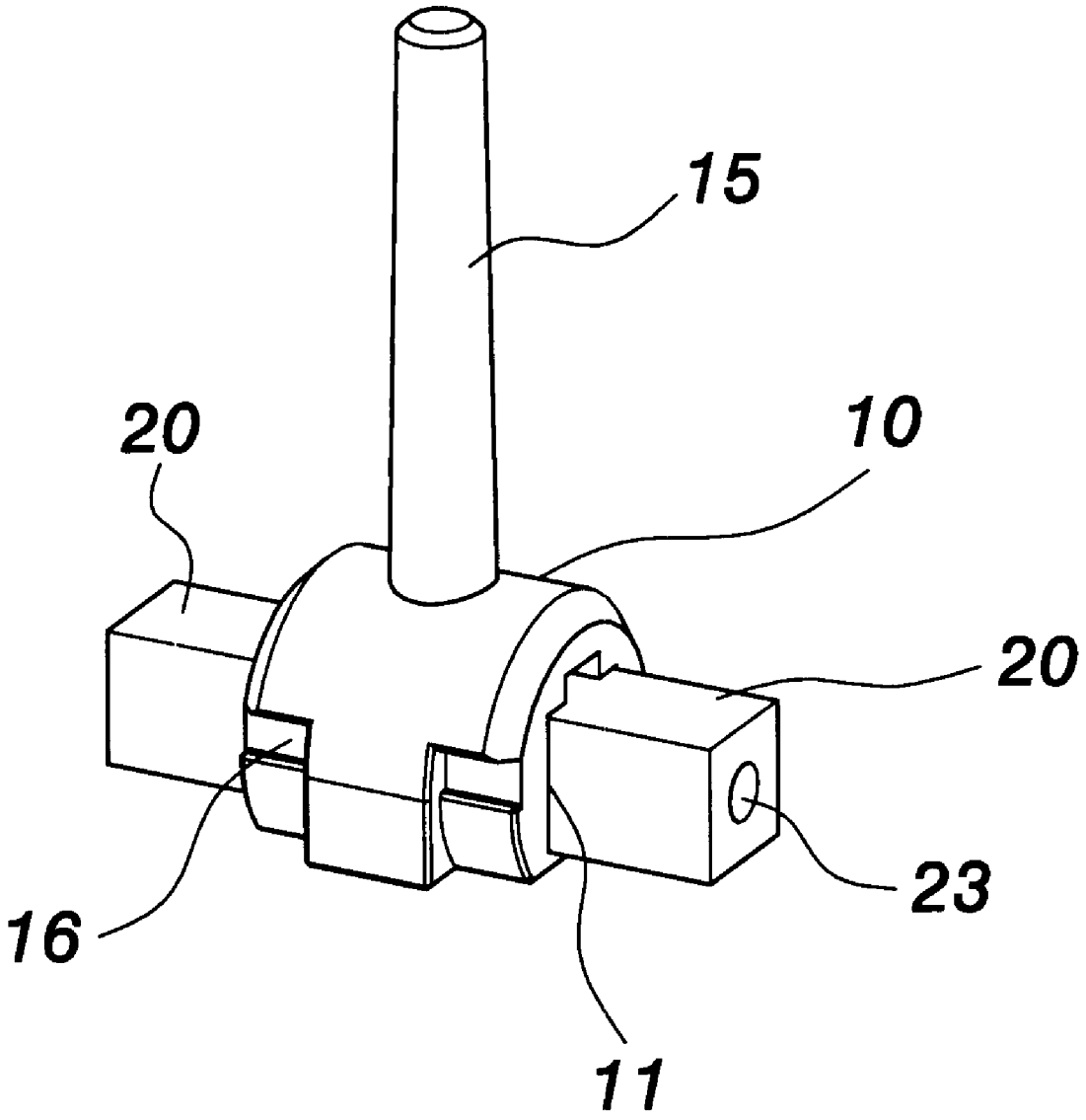
FIG. 2 shows the perspective view of the socket assembly of a projection lamp of the present invention.
Figure 3:
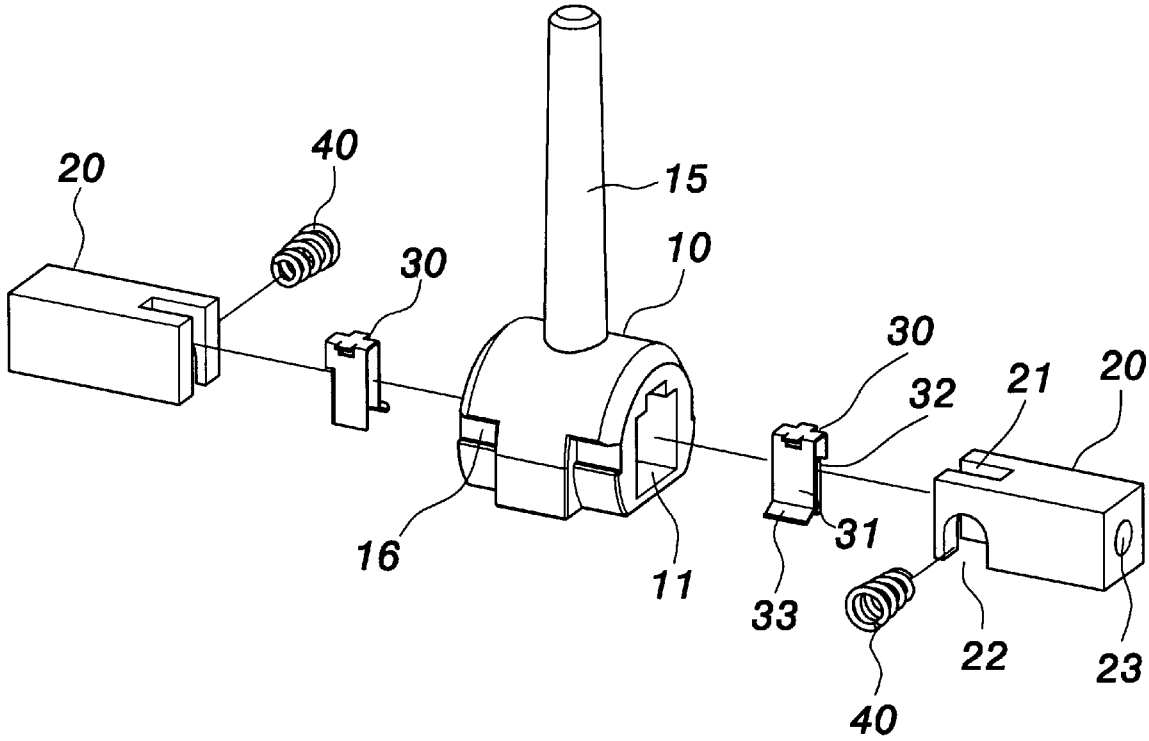
FIG. 3 shows the exploded view of the socket assembly of a projection lamp of the present invention.
Figure 4:
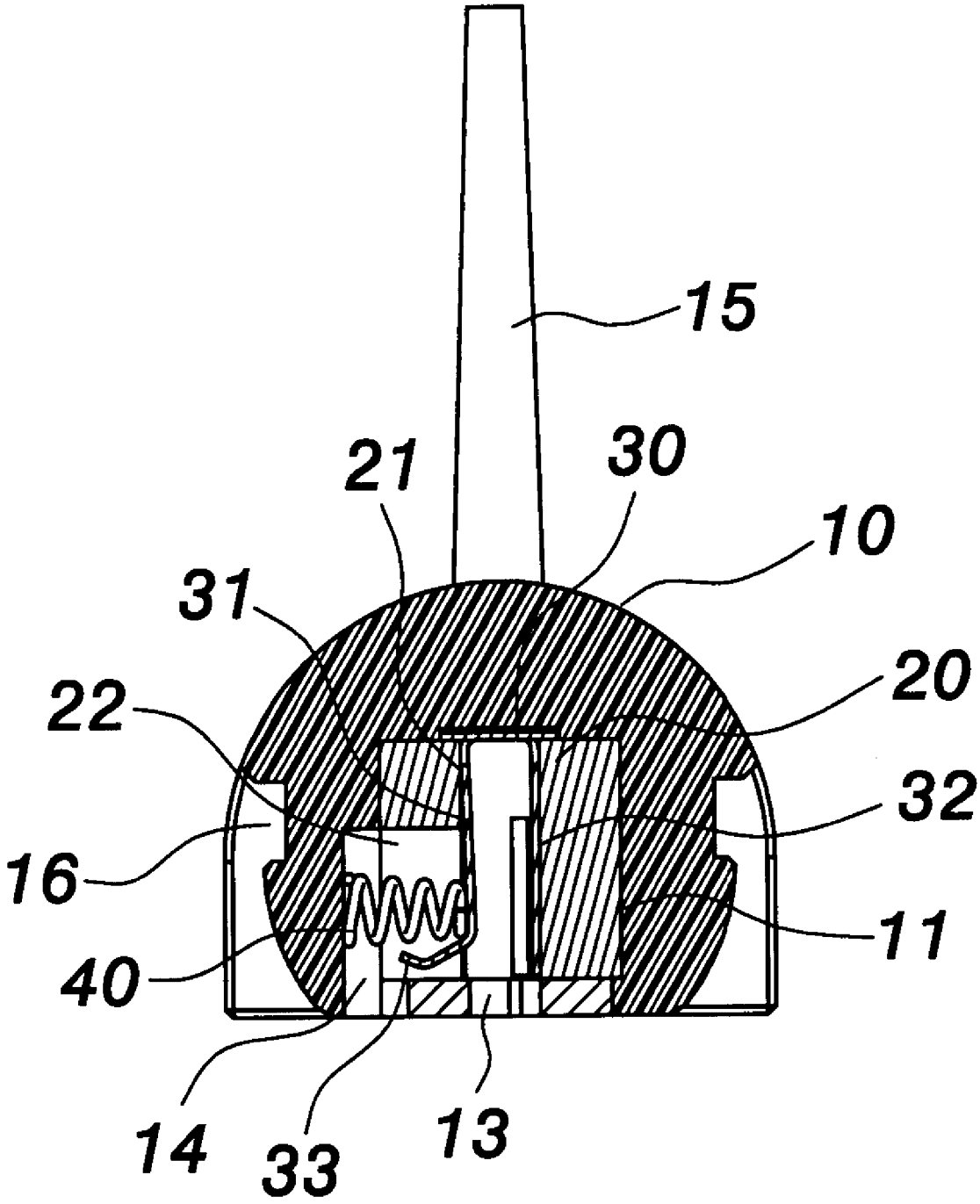
FIG. 4 shows the sectional view of the socket assembly of a projection lamp of the present invention.
Figure 5:
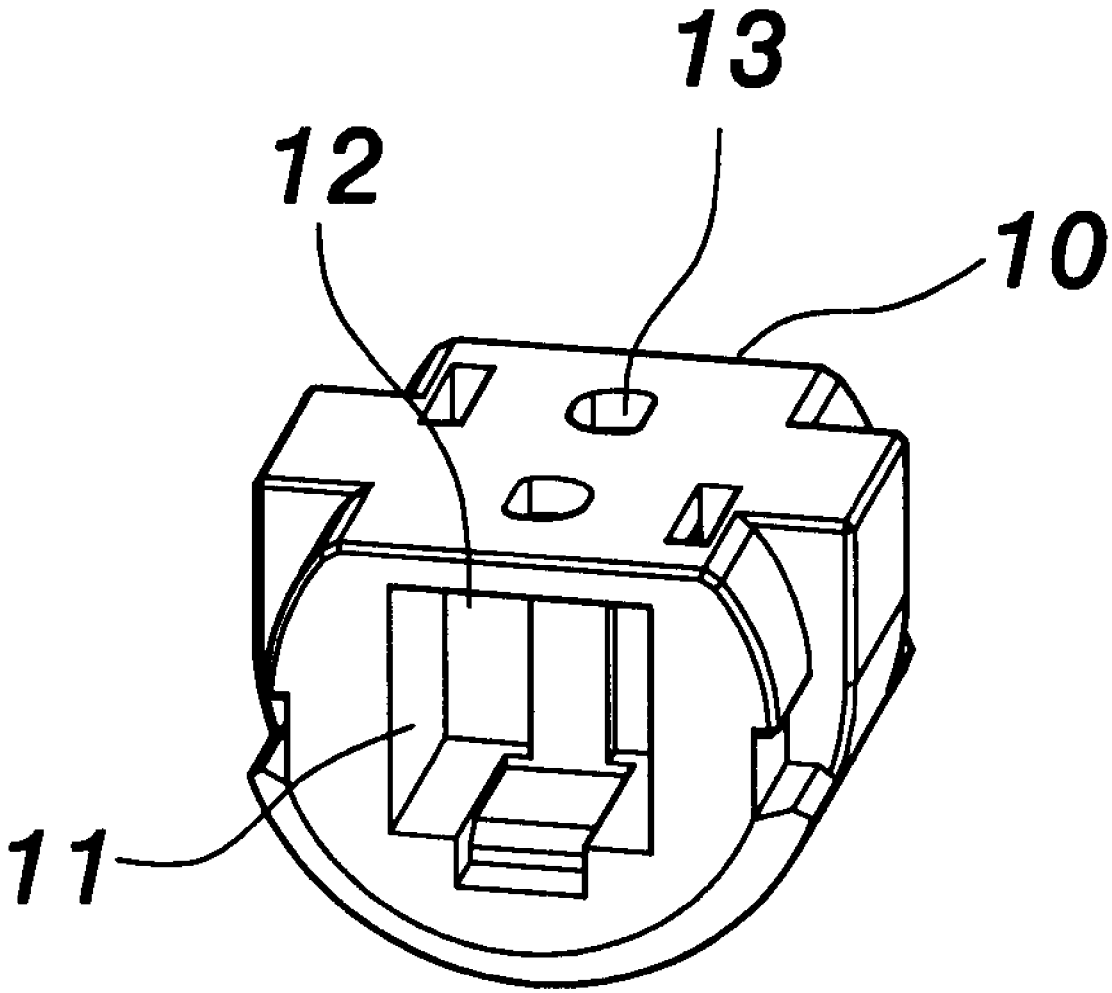
FIG. 5 shows the perspective view of the insulating body of the present invention.

As shown in FIGS. 2, 3 and 4, the present invention provides a socket assembly of a projection lamp. The socket assembly of a projection lamp according to the present invention comprises an insulating body 10, two fixing members 20, two conductive plates 30 and two resilient members 40. The insulating body 10 is made of a plastic material and has two receiving spaces 11 therein. A baffle plate 12 is provided between the two receiving spaces 11, as shown in FIG. 5, to separate the two receiving spaces 11. The insulating body 10 has two insertion holes 13 passing through the internal part of the receiving space 11 to outside. The receiving space 11 has an indent groove 14 on an inner wall thereof.

Figure 6:
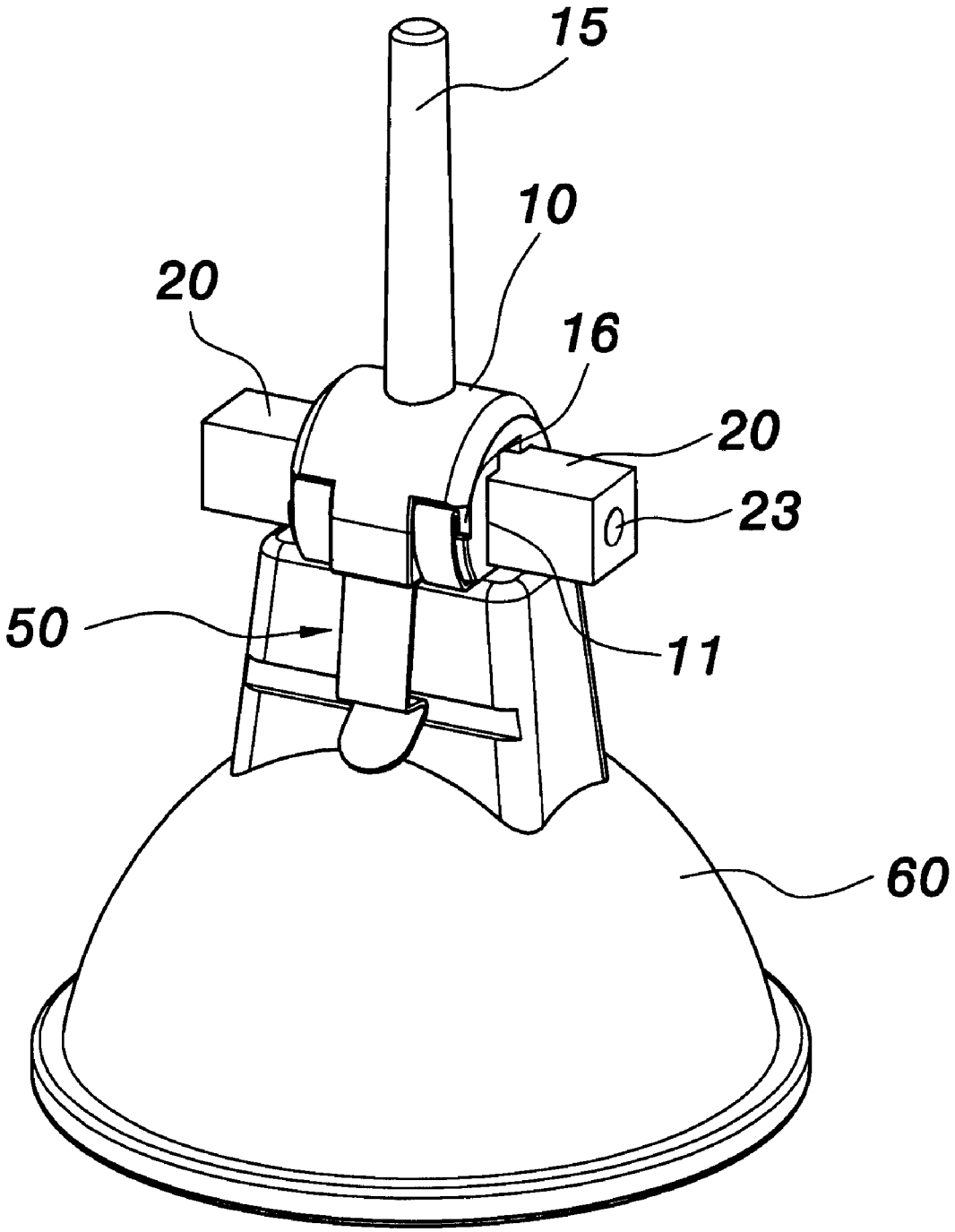
FIG. 6 shows the perspective view of the socket assembly of the present invention assembled with a projection lamp.
Figure 7:
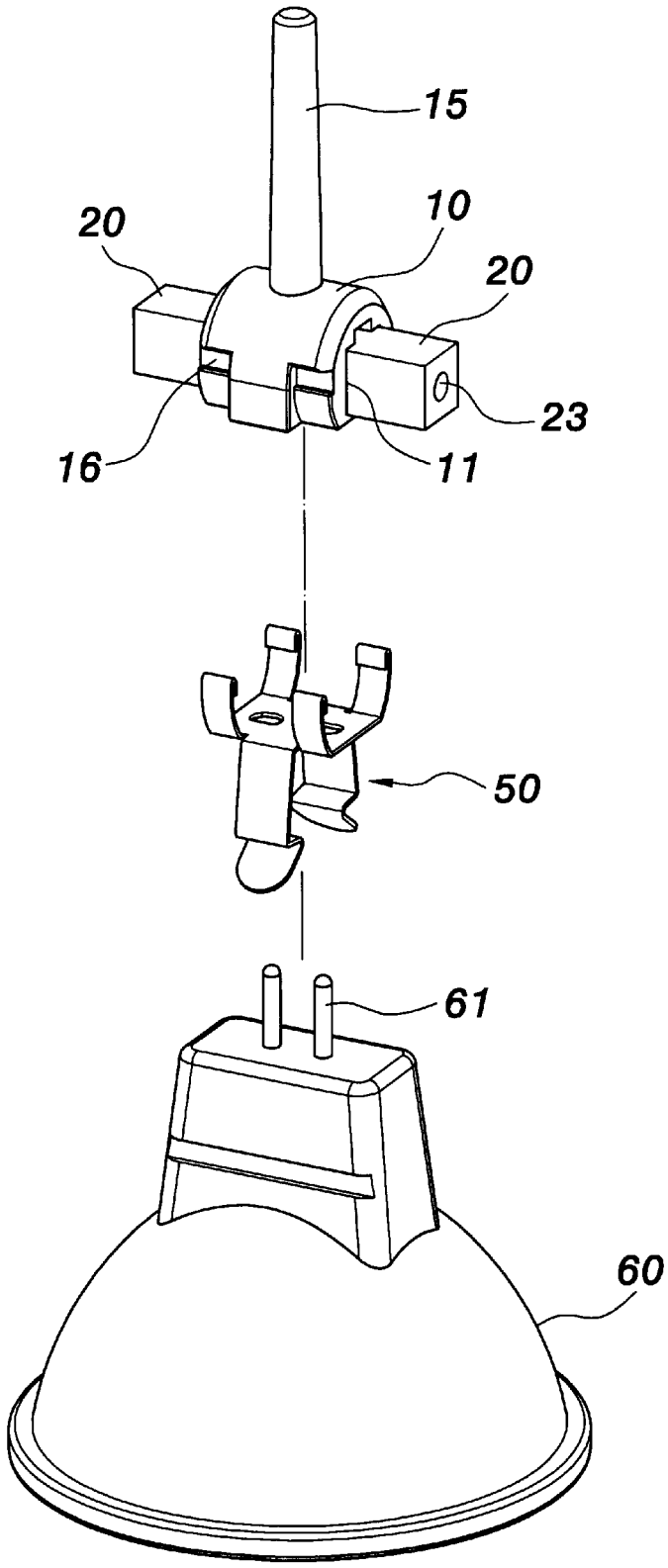
FIG. 7 shows the exploded view of the socket assembly of the present invention assembled with a projection lamp.

The insulating body 10 has a projecting shaft 15 connected on an outer wall thereof. By adjusting the projecting shaft 15, the angle of the socket assembly can be adjusted. The insulating body 10 has two locking grooves 16 on outer walls thereof and opposite to the projecting shaft 15. The two locking grooves 16 are connected to a connection member 50, which is resiliently connected to a lamp 60 as shown in FIGS. 6 and 7. The two leads 61 of the lamp 60 are inserted into the two insertion holes 13 of the insulating body 10. The lamp 60 connected to the insulating body 10 through the connection member 50 does not limit the present invention. Therefore, its connection is not described in detail here.

The two fixing members 20 are made of coppers and have configurations corresponding to that of the receiving space 11 of the insulating body 10. The length of the fixing member 20 is greater than that of the receiving space 11. The fixing member 20 has a receiving recess 21 for conductive plate and a receiving recess 22 for resilient member, at one end thereof. The receiving recess 21 for conductive plate is communicated with the receiving recess 22 for the resilient member 40. The fixing member 20 has a connection hole 23 or an outer thread (not shown) at another end thereof, which is connected to a supportive member or a power unit (not shown), thus inputting power to the two fixing members 20. One end of the fixing member 20 is inserted into the receiving space 11 of the insulating body 10. One end of the resilient member 40 is locked into the indent groove 14 on the inner wall of the receiving space 11. Another end of the fixing member 20 is exposed out of the receiving space 11 by a specific length.

The conductive plates 30 are also made of copper and have a U-shaped body. The conductive plate 30 has a first lateral side 31 and a second lateral side 32. The bottom end of the first lateral side 31 is bent outward to form a slant guiding part 33. The two conductive plates 30 are arranged within the receiving recesses 21. The bottom ends of the conductive plates 30 correspond to the insertion holes 13. When the two leads 61 of the lamp 60 are inserted into the two insertion holes 13, the two leads 61 of the lamp 60 can be placed within the conductive plates 30 and clamped by the first lateral side 31 and the second lateral side 32. Therefore, the two leads 61 of the lamp 60 can be electrically connected to the conductive plates 30 and the fixing members 20. The electrical power can be sent to the two leads 61 of the lamp 60 through the conductive plates 30 and the fixing members 20.

In the present invention, the resilient member 40 is a cone-shaped spring. One end of the cone-shaped spring is fixed to the receiving recess 22 and abuts to the outer wall of the first lateral side 31. Another end of the cone-shaped spring abuts the indent groove 14 on the inner wall of the receiving space 11 to prevent the fixing members 20 from being pulled out of the space 11, whereby the resilient member 40 is placed between the insulating body 10 and the conductive plates 30 and the clamping force of the conductive plates 30 can be increased. The resilient member 40 pushes the first lateral side 31 to firmly clamp the two leads 61 of the lamp 60 within the conductive plates 30.

The inventive socket assembly for a projection lamp has a simple structure and can be assembled by simply inserting one end of each fixing member 20 into the receiving space 11. Therefore, the inventive socket assembly for a projection lamp does not need screws and nuts. Moreover, by clamping the two leads 61 of the lamp 60 with the conductive plates 30, the lamp 60 can be easily assembled.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A socket assembly of a projection lamp, comprising:

an insulating body having two receiving spaces therein and two insertion holes providing access to the respective receiving spaces from outside;

two fixing members, each having a first receiving recess, one end of each fixing member being tightly inserted into a respective receiving space;

two conductive plates, each having a first lateral side and a second lateral side, the two conductive plates being arranged within the respective first receiving recesses, the conductive plates each having a bottom end facing the respective insertion holes; and two resilient members, each being provided between the insulating body and a respective conductive plate, wherein each fixing member has a second receiving recess, which is in communication with the respective first receiving recess; each resilient member being a cone-shaped spring, one end of each resilient member being arranged within a respective second receiving recess and abutting the first lateral side of the respective conductive plate.

2. The socket assembly of projection lamp as in claim 1, wherein the insulating body has a baffle plate provided between the two receiving spaces.

3. The socket assembly of projection lamp as in claim 1, wherein each receiving space has an inner wall provided with an indent groove, one end of each resilient member abutting a respective indent groove.

4. The socket assembly of projection lamp as in claim 1, wherein each fixing member has a connection hole or an outer thread; each fixing member being exposed out of a respective receiving space by a predetermined length.

5. The socket assembly of projection lamp as in claim 1, wherein each conductive plate has a bottom end bent outward to form a slant guiding part.

* * * * *